United States Patent [19]

Jelinek et al.

[11] 4,285,259

[45] Aug. 25, 1981

[54] TURRET INDEX SYSTEM

[75] Inventors: Ross R. Jelinek, North Tonawanda; Victor T. Carbone, Cheektowaga, both of N.Y.; Paul R. Brown, Walnut Creek, Calif.

[73] Assignee: Houdaille Industries, Inc., Fort Lauderdale, Fla.

[21] Appl. No.: 68,445

[22] Filed: Aug. 21, 1979

[51] Int. Cl.[3] ..... B26F 1/04

[52] U.S. Cl. ..... 83/552; 74/813 R; 29/36; 29/48.5 R; 29/48.5 A

[58] Field of Search ..... 83/549, 551, 552; 29/36, 48.5 R, 48.5 A; 74/813 R

[56] References Cited

U.S. PATENT DOCUMENTS

| | | | |
|---|---|---|---|
| 2,701,017 | 2/1955 | Wiedemann | 83/552 |
| 2,995,958 | 8/1961 | Jungeling et al. | 74/813 |
| 3,080,512 | 3/1963 | Cubbidge et al. | 74/813 |
| 3,085,452 | 4/1963 | Thompson | 74/813 |
| 3,174,378 | 3/1965 | Friedland | 83/552 |
| 3,377,887 | 4/1968 | Nelson et al. . | |
| 3,853,029 | 12/1974 | Todd | 83/552 |
| 4,165,669 | 8/1979 | Brown et al. | 83/552 |

FOREIGN PATENT DOCUMENTS

| | | | |
|---|---|---|---|
| 696115 | 10/1964 | Canada | 74/813 |

*Primary Examiner*—J. M. Meister
*Assistant Examiner*—K. Bradford Adolphson
*Attorney, Agent, or Firm*—Hill, Van Santen, Steadman, Chiara & Simpson

[57] ABSTRACT

A turret indexing system for a turret punching machine having a plurality of equally spaced tool punching stations carried on the turrets which may be rotatably positioned to place selected punching tools in register with a punching ram. Turret indexing is accomplished with a pneumatic cylinder driven reciprocating drive arrangement utilizing a pneumatically actuated clutch to drive the turrets through a one direction, incremental indexing rotation which is equivalent to one tool punching station spacing. A shot pin arrangement is effective to lock the turrets in an operating position and provide small corrective repositioning of the turrets, when required, to precisely position the turrets relative to the punching ram. A control system provides an automatic sequenced cycling of the indexing system to position each required punching tool in an accurate punching position.

7 Claims, 7 Drawing Figures

FIG. 5
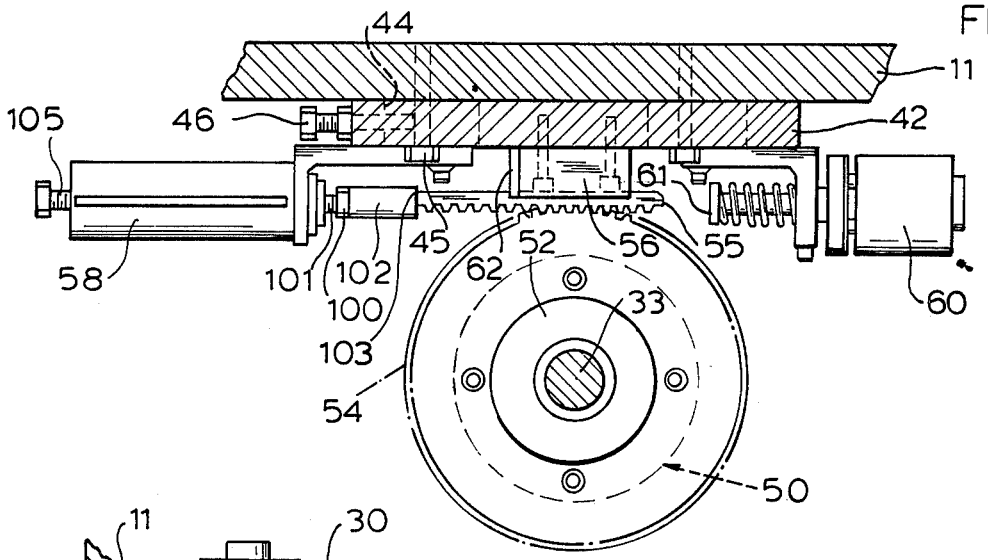
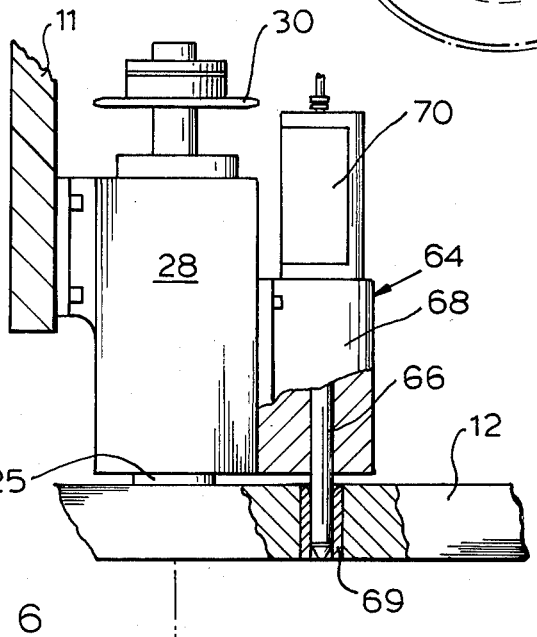
FIG. 6
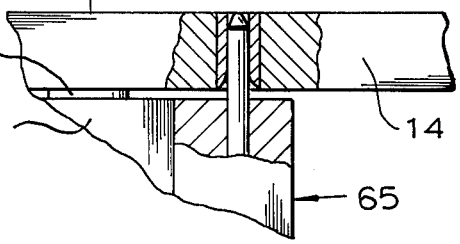
FIG. 7
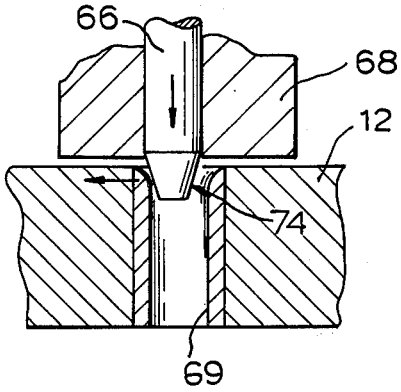
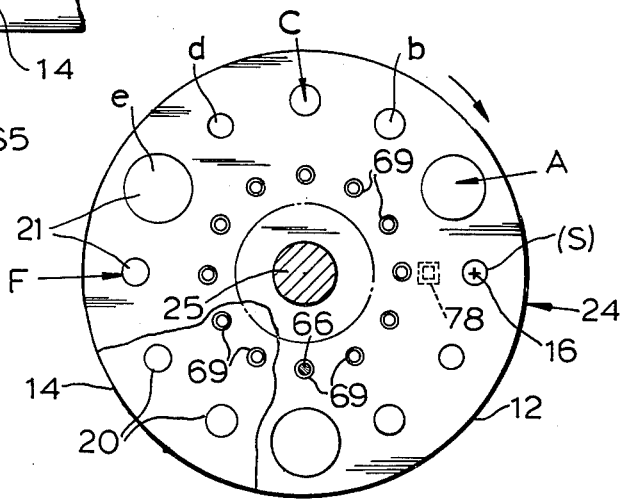
FIG. 3

TURRET INDEX SYSTEM

BACKGROUND OF THE INVENTION

1. Field of the Invention

This invention relates to a turret indexing system and more particularly to a semi-automatic electro-mechanical arrangement for indexing turrets in a punching machine or the like.

2. Prior Art

High performance turret punching machines providing automated turret positioning systems which are controlled from a central processor such as a computer, taper reader, or the like are presently widely used. These numerical control systems while providing a machine with accurate high speed turret indexing are exceedingly complex and expensive. However, with the use of less sophisticated turret type punching machines, indexing procedures have been relatively slow. Accordingly, a punching machine with a rapid semiautomatic turret station indexing system would be a decided advance in the state of the art.

SUMMARY OF THE INVENTION

This invention provides a semiautomatic hole punching machine having a rapid turret indexing system for selectively positioning predetermined turret punching elements in a punching position relative to an operating ram to punch required holes in a work piece. An upper turret member provides a plurality of punch assemblies supported thereon in equally spaced orientation with a lower turret member carrying a plurality of dies which are complementing to and moved in synchronization with the upper turret punch assemblies into register with a machine punching axis as required. The indexing system includes individual chain drives to the upper and lower turrets which are driven from a common drive shaft mounted vertically on the punching machine frame. The drive shaft carries an index gear which is arranged to rotate the drive shaft in a monodirectional incremental fashion to indexably advance the upper and lower turrets one punching station spacing with each cycle of the indexing system. The index gear drivably meshes with a rack which is reciprocably driven through a generally fixed stroke by a pneumatic cylinder. A pneumatically actuated clutch provides a driving couple between the index gear and the drive shaft for drivably indexing the turrets and allows the mating rack and index gear to move in a reverse direction when the clutch is disengaged to recycle the cylinder without rotating the drive shaft. Thus, a high force, rapid indexing drive system is provided to rotatably position the desired punching elements on the turrets in register with the machine punching axis. Due to resultant inertial forces associated with this arrangement, a shock absorber is provided to cushion the last portion of the cylinder stroke to dissipate the inertia of the rotating turrets.

Due to the inertia in the system, however, slight variations in the indexing stroke can occur resulting in slight misalignment of the punching elements with the machine punching axis. Herein, a pair of shot pins normally utilized to fix the position of the turret frames in a punching position are also arranged to provide small corrective repositioning of the turrets when required, to accurately spot the turrets in the punching position. An electrical control system provides an automatic sequenced control of the indexing cycle.

It is therefore an object of the present invention to provide a semiautomatic apparatus for rapidly indexing a punching machine turret.

It is a more specific object of the present invention to provide a novel semiautomatic turret indexing system capable of achieving rapid and accurate indexing, which system is comparatively simple and inexpensive.

It is a further object of the present invention to provide a semiautomatic turret indexing system which automatically provides small corrective repositioning of the turrets when overtravel or undertravel rotational errors are encountered.

It is yet another object of the present invention to provide a semiautomatic turret indexing system which is mono-directional and incrementally indexed through the use of a rack and gear arrangement powered by a pneumatic cylinder.

Other objects, features and advantages of the invention will be readily apparent from the following description of a preferred embodiment thereof, taken in conjunction with the accompanying drawings although variations and modifications may be effected without departing from the spirit and scope of the novel concepts of the disclosure.

BRIEF DESCRIPTION OF THE DRAWINGS

FIG. 3 is a sectional view taken generally along the lines III—III of FIG. 2;

FIG. 5 on the third page of drawings is a horizontal sectional view taken generally along the lines V—V of FIG. 4;

FIG. 6 is an enlarged fragmentary view of the turret assembly and shot pin devices; and FIG. 7 is an enlarged fragmentary view showing a shot pin effecting a corrective repositioning of the turret assembly.

DETAILED DESCRIPTION OF THE PREFERRED EMBODIMENT

Figure 1:
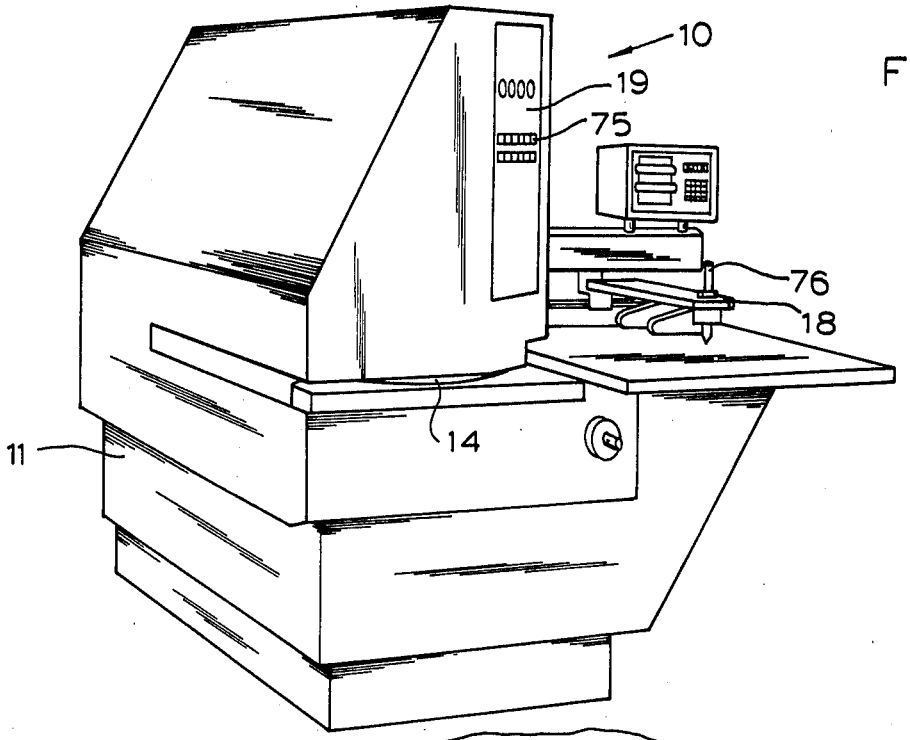
FIG. 1 is a perspective view of a turret punch machine tool equipped with a semi-automatic turret indexing system.
Figure 2:
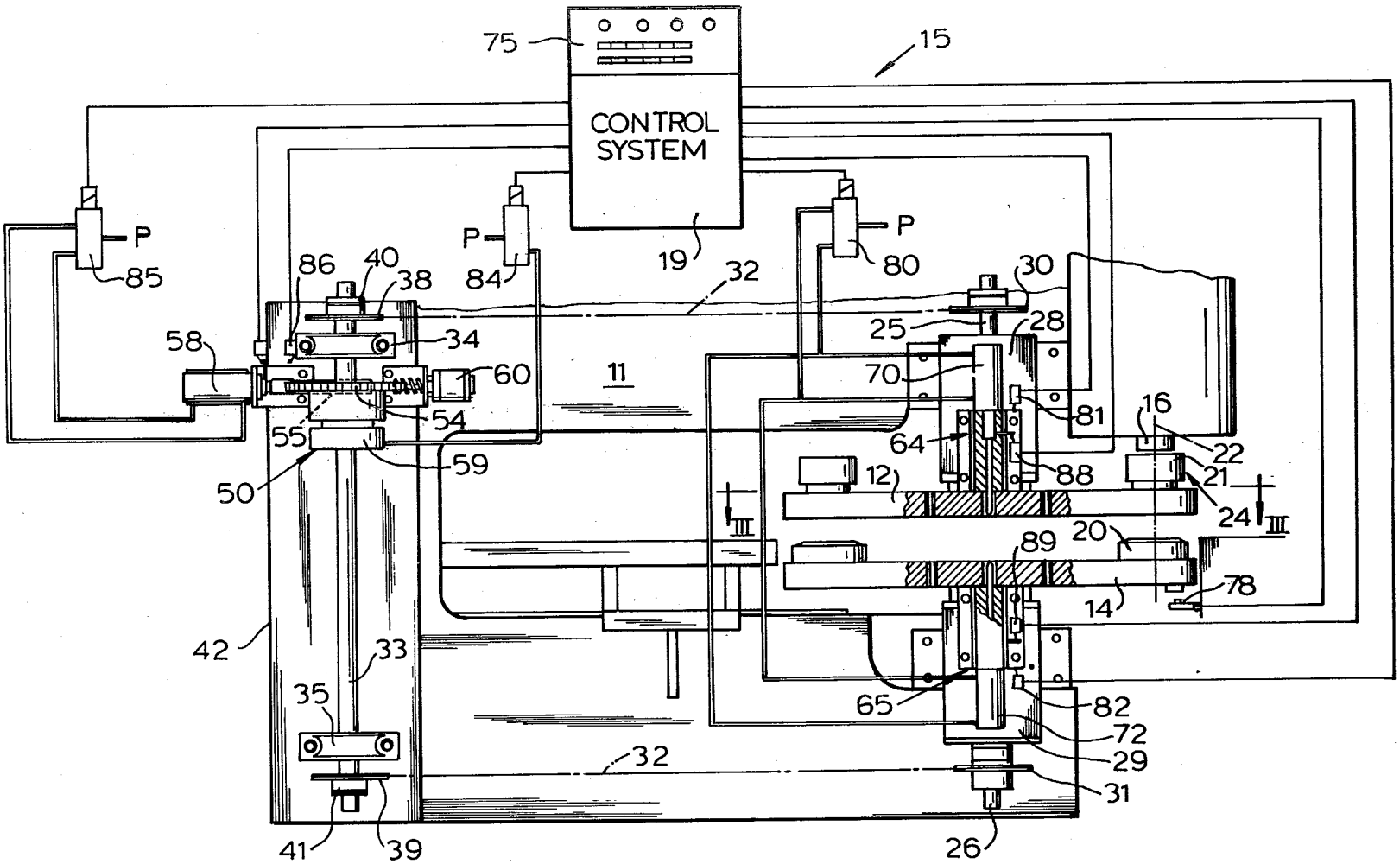
FIG. 2 is a diagrammatic view of the machine tool turret indexing system in accordance with the present invention.

As best seen in FIGS. 1 and 2, a machine tool turret punch 10 is shown which includes a main frame 11, an upper turret assembly 12, a lower turret assembly 14, a turret indexing system 15, a ram assembly 16, a workpiece positioning mechanism 18 which is operable to move a workpiece to desired punching positions relative to the turret assemblies 12 and 14 and a control system 19.

The turret assemblies 12 and 14 are rotatably supported on the main frame 11 in a vertically spaced apart orientation. The turrets contain a plurality of complementary dies 20 and punches 21 which are positionable relative to a punching axis 22. Each set of dies and punches define a turret punching station with the turrets being rotatable to align any given complementing punch and die with the ram assembly 16 at the machine work station 24. As best seen in FIG. 3 the upper turret assembly 12 includes twelve equally spaced punching stations, each station defining a punch 21 location. The lower turret assembly 14 similarly includes twelve punching stations with dies 20 maintained in vertical alignment with complementary punches on the upper turret assembly 12 during indexing. As best seen in FIG. 2 each of the turret assemblies 12 and 14 are carried on a related shaft 25, 26 which shafts are rotatably supported on the main frame 11 by means of bearing supports 28 and 29.

A drive sprocket 30, secured to the upper turret shaft 25 and a drive sprocket 31, secured to the lower turret shaft 26 provide chain drive connections 32 between each turret assembly and a vertically supported drive shaft 33. The sprockets 30 and 31 are secured to their respective turret shafts 25 and 26 by means of tapered bushings 36 and 37. The drive shaft 33 is rotatably supported on the main frame 11 by means of spaced self-aligning pillow blocks 34, 35.

Drive sprockets 38 and 39 are affixed to opposite ends of the drive shaft by means of tapered bushings 40 and 41. The tapered bushings, when loosened, allow the upper and lower chain drive connections 32 to adjustably align themselves with one another so as to eliminate misalignment between the turrets, and when tightened down maintain this adjustment. The tapered bushings 36 and 37 for sprockets 30 and 31 provide similar adjustability. This aligning procedure eliminates any mechanical opposition between the turrets which could over stress system components and could contribute to inconsistent operation. Thus it will be seen that the drive shaft 33 is effective to rotatably drive both turret assemblies in synchronism to position desired tool punching stations in the work station 24.

Figure 4:
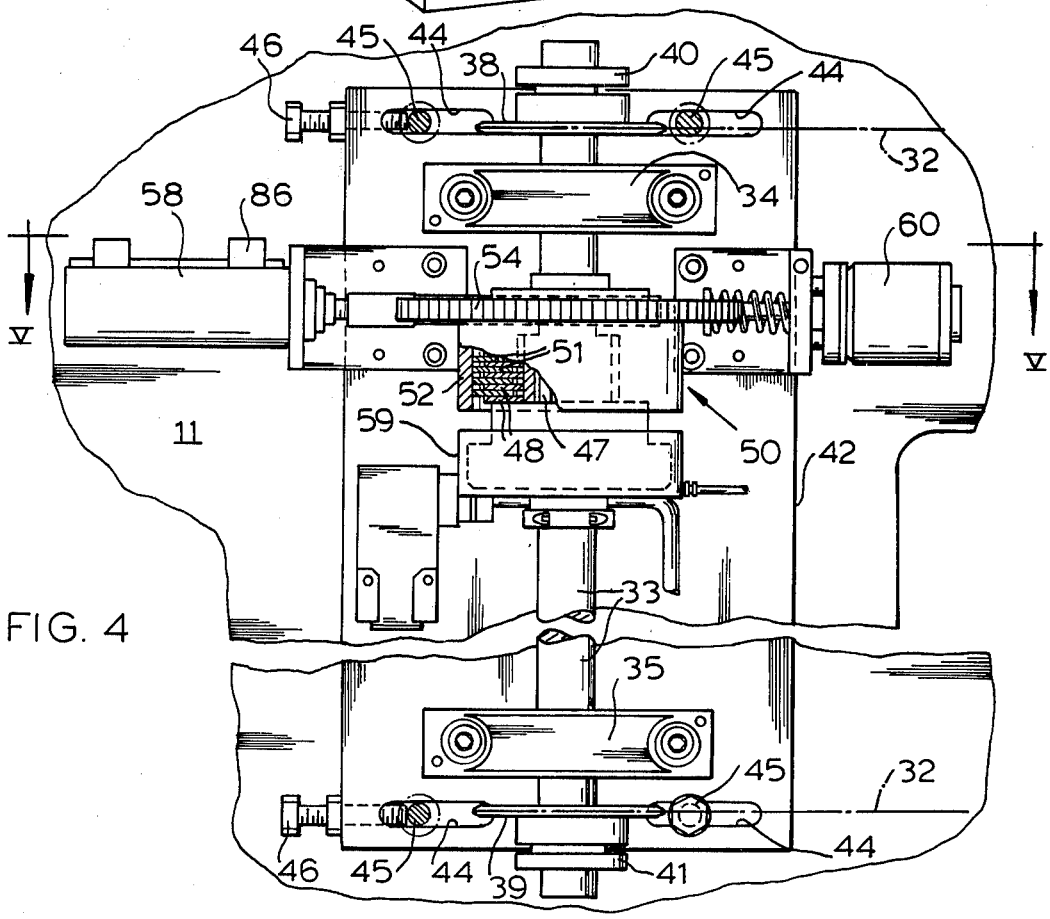
FIG. 4 on the first page of drawings is an enlarged fragmentary view of the turret indexing drive arrangement.

Now with the specific reference to FIG. 4, the drive shaft pillow block 34, 35 are shown carried on an adjustment plate 42 having slotted mounting holes 44 through which mounting bolts 45 extend to secure the plate 42 to the main frame 11. Adjusting screws 46 are provided to facilitate shifting the plate 42 relative to the main frame 11 to effect a tensioning of the drive chains 32 to eliminate backlash and insure that the turrets rotate with maximum accuracy.

The drive shaft 33 includes a splined hub 47 which drivably engages a series of alternating disks 48 of a multiple-disk clutch 50. A second series of disks 51, alternating with the disks 48, are splined to the clutch housing 52. An index gear 54 is secured to the housing 52 and meshes with a rack 55 as best seen in FIG. 5. The rack 55 is supported for reciprocating translational movement on a guide block 56 and is drivably carried by an air cylinder 58. The air cylinder 58 drives the rack 55 through a predetermined fixed stroke approximating the distance required to advance the turret assemblies 12 and 14 the equivalent of one tool station.

The multiple-disk clutch 50 also includes a pneumatic actuator 59 (as best seen in FIG. 4) which when pressurized imposes a pressure on the disks to provide a friction drive from the index gear 54 to the splined hub 47 of the drive shaft 33. When the pressure to the actuator 59 is released the clutch disks are allowed to slip relative to one another providing for a retracting cylinder stroke without rotating the drive shaft 33 and the turret assemblies 12 and 14. With each extension (indexing stroke) of the cylinder 58 the drive shaft is rotatably driven through the pneumatically engaged clutch 50 and with each retraction (recycling stroke) of the cylinder 58, at which time the clutch will be disengaged, the drive shaft remains stationary. Thus it will be seen that the turret assemblies are rotated in a monodirectional incremental fashion to indexably advance the upper and lower turret assemblies one tool punching station spacing with each cycle of the indexing system 15.

A shock absorber 60 mounted on the adjustment plate 42 opposite the cylinder 58 is effective to cushion a final portion of the cylinder stroke so as to control the speed of the indexing to dissipate the inertia of the rotating turret assemblies. The clutch 50 would tend to override with each indexing rotation without the damping of the shock absorber 60. After the rack 55 extends to approximately one-half its travel, a plunger 61 intercepts an end surface of the rack 55 to decelerate the turret assemblies during the final portion of the indexing stroke. An impact wear strip 62 (see FIG. 5) sets the limit of the stroke travel.

In order to allow adjustment of the length of the stroke of the rack 55, an adjustable connection 100 is provided between the moving rod 101 of cylinder 58 and the rack 55. In this manner the extent of projection of the rack from the cylinder is adjustable. The rack 55 or some portion of the rack-rod connection member 102 on the rack side of the adjustable connection 100 is provided with an abutment face 103 abutable with the wear strip 62 to terminate the stroke. The cylinder 58 may also be provided with an adjustment device 105 to adjust back stroke movement termination. In such a manner the stroke length of the rack can be varied. One advantage of this is that variations caused by wear or looseness which occur over periods of use can be compensated for. Of course, other means of providing adjustment of the stroke length will be readily apparent to those skilled in the art.

Due to variations in the indexing systems' inertia, reflective of turret assemblies loaded with punching tools or having only a few tools, the fixed indexing stroke will be only approximately accurate and can vary positively or negatively between each indexing station move. While the variations in indexing travel are minimal between a single station movement, this difference between the actual travel and the exact station location can accumulate over a number of indexing cycles to a degree of misalignment which can seriously affect the machine tool turret punch 10 operation. Herein, shot pin assemblies 64 and 65 are provided to lock the operating positions of the turret assemblies and also to reposition the turrets a small incremental distance into exact registration with the punching axis 22. A shot pin 66 is supported in a guide support 68 for a vertical locking movement into a bushing 69 carried by the upper turret assembly 12. Each turret punching station is equipped with an individual bushing 69 whereby the punching tools carried at each station may be accurately locked in the working station 24. A pneumatic cylinder 70 is operatively connected to the shot pin 66 for extending and retracting the shot pin relative to the turret assembly 12. The shot pin assembly 65 for locking the position of the the lower turret assembly 14 is generally identical in construction and operation to the shot pin assembly 64 and accordingly will not be described in detail.

As best seen in FIG. 7, after the turret assembly 12 is rotatably indexed and because of inertial influences described above the turret assembly does not exactly come into alignment with the shot pin 66, a lower camming portion 74 of the pin 66 enters the bushing 69 to urge the turret assembly into alignment therewith while placing a related tool punch in register with the ram assembly 16 at the work station 24. Obviously, the shot pin is fired into the turret assembly after the clutch 50 is disengaged in order to accommodate these corrective repositioning movements.

In operation, after the machine operator selects one or more desired turret punching stations by pressing appropriate switches or buttons at the control panel 75 of the control system 19 and presses a reset button to position a start station (S) of the turret assemblies in the machine work station 24, the indexing cycle associated with punching of a workpiece will begin. In order for the control system 19 to recognize when the start station (S) is in position a "Hall effect" switch 78 carried on the lower turret 14 is energized to signal the control system 19 that the turret assemblies are in position. During the zeroing cycle, the control causes the turrets to continue to index until station (S) is under the ram assembly 16 at the work station 24 at which point it will stop.

The control system 19 includes various standard system components, the specific details of which are well known to those skilled in the art and do not in themselves form a part of this invention.

Now with the turrets in a starting cycle position as shown in FIG. 3 and with stations A, C and F selected as the required tool punching stations to be used, the machine operator presses a turret index pushbutton on a handle 76 of the workpiece positioning mechanism 18 which begins the index cycle by retracting the shot pins of the shot pin assemblies 64 and 65 from the upper and lower turret assemblies 12 and 14. The shot pins are retracted by pressurizing the pneumatic cylinders 70 and 72 by means of a solenoid valve 80 which is under the control of the control system 19. At the end of the cylinder retraction strokes, limit switches 81 and 82 signal the control 19 that the pins are retracted and causes a solenoid valve 84 to pressurize the pneumatic actuator 59 and engage the clutch 50 to lock the index gear 55 to the drive shaft 33. After a short time delay the index rack 55 is extended approximately 2.00" by the pneumatic cylinder 58 which is activated by a solenoid valve 85, controlled by the control system 19. This action rotates the index gear 54 and in turn rotates the upper and lower turret assemblies 12 and 14 approximately 30° (the equivalent of one turret station spacing).

It will be remembered that the last portion of the indexing stroke is cushioned by the shock absorber 60. A limit switch 86 signals the control system 19 that the cylinder 58 has extended the rack 55 to its proper position and is also effective to count each turret index cycle.

Once the index rotation of the turrets is completed and after a short time delay the clutch 50 is disengaged to release the drive connection between the drive shaft 33 and the index gear 54. Also at this time the shot pin cylinders 70 and 72 are actuated by the solenoid valve 80 to extend the shot pins into a locking engagement with their respective turret assemblies. When the shot pin cylinders 70 and 72 reach the ends of their strokes limit switches 88 and 89 are closed to signal the control system 19 to effect a retraction of the index rack 55 by the operation of the solenoid valve 85 to pressurizing the cylinder 58.

The above sequenced operations complete one turret station indexing cycle which would be effective to advance the turret punching station A to the operative position in the machine work station 24 to perform the punching operation on a suitably positioned workpiece (not detailed).

The control system 19 is arranged to stop only at the selected stations. Since the next station to be used is station C after completing operations using station A, the operator depresses the unit index pushbutton on the handle 76 whereupon the control system 19 continues to cycle as described above until station C is reached at which point it stops, station b having been bypassed. Similarly when going from station C to station F, the indexing cycles are repeated, passing station d and e and stopping when station F is reached.

Although the preferred turret indexing system 15 as described is operative to rotatably index the turret assemblies clockwise one station spacing, as shown in FIG. 3, with each indexing cycle; the control system 19 may be programmed to indexably rotate the turret assemblies in an opposite or counterclockwise direction. Herein, energization of the clutch 50 would coincide with the retraction stroke of the cylinder 58 thereby rotating the drive shaft 33 in an opposite direction to that as previouslv described. Further the control system 19 may be programmed to selectively engage the clutch 50 for bi-directional indexing if desired. Obviously, these embodiments would require a modification in the shock absorber arrangement.

Although the teachings of our invention have herein been discussed with reference to a specific embodiment, it is to be understood that these are by way of illustration and that variations and modifications may be effected without departing from the spirit and scope of the novel concepts of our invention.

We claim as our invention:

1. A turret index system for a punching machine having spaced apart upper and lower turret assemblies, each having a plurality of punching elements carried thereon at equally spaced turret punching stations with each upper and lower station providing functionally complementary punching elements which are rotatable for positioning in alignment with a machine punching axis, wherein the improvement comprises:

a rotary drive means being drivably connected to said upper and lower turret assembly for synchronously driving said turret assemblies;

said rotary drive means includes an index gear and said reciprocating drive means includes a rack which meshes with said index gear and being moved by a power cylinder through a predetermined indexing stroke length to rotate said index gear the equivalent of one turret station spacing;

a reciprocating drive means having a driving connection with said rotary drive means and a shock absorber associated with said rack to decelerate said turret assemblies during a final portion of the indexing stroke length.

a releasable drive couple means for driving said rotary drive means from said reciprocating drive means and arranged to transmit incremental rotary motion to said rotary drive means to indexably advance both of said turret assemblies the equivalent of one station spacing;

said releasable drive couple means including a clutch means arranged to transmit incremental rotary motion to said rotary drive means and wherein the rotary drive means includes a drive shaft carrying spaced sprockets thereon, upper and lower roller chains indexing with said sprockets, said chains each having an operative drive connection with one of said turret assemblies for driving each of said turret assemblies simultaneously from said rotary drive means, said drive shaft being positioned remote from said turrets;

a shot pin means arranged to lock the indexed position of said turret assemblies and provide required corrective repositioning movements to achieve accurate positioning of said turret assemblies relative to said machine punching axis; and a control system to sequentially control the operation of said rotary drive means, the reciprocating drive means, the releasable drive couple means and said shot pin means whereby selected turret assembly punching stations are accurately indexed relative to said machine punching axis.

2. The turret indexing system of claim 1 wherein said rotary drive means includes said drive shaft being connected to said index gear upon the engagement of said releasable drive couple means, said releasable drive couple means including said clutch means, and means to engage and disengage said clutch means to rotatably drive said turret assemblies in synchronism with a monodirectional, incremental rotary motion.

3. The turret indexing system of claim 2, wherein said drive chain connections are arranged to be adjustably aligned with one another to synchronize turret assembly positioning.

4. The turret indexing system of claim 2, wherein said clutch means includes:

a clutch housing having said index gear affixed thereto and being internally splined;

a hub member carried on said drive shaft and being externally splined;

a set of disks alternately engaging said clutch housing and said hub member; and a pneumatic actuator arranged to frictionally engage said disks whereby a driving couple is provided between said index gear and said drive shaft when said actuator is pressurized.

5. The turret indexing system of claim 2, wherein said shot pin means includes individual shot pins for each turret assembly and being movable by a related cylinder into engagement with said turret assemblies to first reposition and subsequently lock said turret assemblies in accurate alignment with said machine punching axis.

6. The turret indexing system of claim 2, wherein said control system includes individual turret station selector switches and a turret indexing pushbutton whereby certain turret stations may be preselected and whereupon said turret indexing pushbutton is effective to energize said control system to cyclically and sequentially position each preselected turret station in alignment with said machine punching axis.

7. The turret indexing system of claim 6, wherein said control system further includes a reset button and a start station sensor carried on one of said turret assemblies at an index start station whereby said reset button is effective to energize said control system to indexably advance said index start station to a position aligned with said machine punching axis.

* * * * *